US010563962B2

(12) United States Patent
Bengtson

(10) Patent No.: US 10,563,962 B2
(45) Date of Patent: Feb. 18, 2020

(54) VANE FOR AN ARROW, AND AN ARROW EXHIBITING VANES

(71) Applicant: Bjorn R. Bengtson, Huddinge (SE)

(72) Inventor: Bjorn R. Bengtson, Huddinge (SE)

( * ) Notice: Subject to any disclaimer, the term of this patent is extended or adjusted under 35 U.S.C. 154(b) by 164 days.

(21) Appl. No.: 15/317,303

(22) PCT Filed: Jun. 15, 2015

(86) PCT No.: PCT/SE2015/000036
§ 371 (c)(1),
(2) Date: Dec. 8, 2016

(87) PCT Pub. No.: WO2015/190973
PCT Pub. Date: Dec. 17, 2015

(65) Prior Publication Data

US 2017/0122711 A1 May 4, 2017

(30) Foreign Application Priority Data

Jun. 13, 2014 (SE) ..... 1400301

(51) Int. Cl.
*F42B 6/06* (2006.01)

(52) U.S. Cl.
CPC ..... *F42B 6/06* (2013.01)

(58) Field of Classification Search
CPC ..... F42B 6/06
USPC ..... 473/578, 586
See application file for complete search history.

(56) References Cited

U.S. PATENT DOCUMENTS 2,887,319 A * 5/1959 Lay ..... F42B 6/06 473/586
3,667,758 A 6/1972 Bengtson
3,853,320 A * 12/1974 Carella ..... F42B 6/06 473/586
4,234,192 A * 11/1980 Salamone ..... F42B 6/06 473/586
4,477,084 A * 10/1984 Austin ..... F42B 6/06 244/3.24
4,615,552 A * 10/1986 Bengtson ..... F42B 6/06 244/3.24
5,024,448 A * 6/1991 Barrie ..... F42B 6/06 473/586
5,613,688 A * 3/1997 Carella ..... F42B 6/06 473/586

(Continued)

FOREIGN PATENT DOCUMENTS

EP 0255563 A1 2/1988

OTHER PUBLICATIONS

International Search Report and Written Opinion for corresponding Patent Application No. PCT/SE2015/000036 dated Oct. 2, 2015.

*Primary Examiner* — Alexander R Niconovich
(74) *Attorney, Agent, or Firm* — Renner, Otto, Boisselle & Sklar, LLP

(57) ABSTRACT

The present invention relates to fletching or vanes for arrows in archery and crossbow shooting, guiding the flight of the arrow through the air after the release, i.e. when the archer has released the arrow, and the arrow has left the string, and more particularly to a fletching or vane for quick stabilization of the flight of an arrow immediately after the release at instances of interference of the arrow with the bow, as well as an arrow fletched with such vanes.

7 Claims, 1 Drawing Sheet

(56) References Cited

U.S. PATENT DOCUMENTS

| | | | | |
|---|---|---|---|---|
| 7,455,605 | B2 * | 11/2008 | Rangel | F42B 6/06 473/586 |
| 8,038,552 | B2 * | 10/2011 | Song | F42B 6/06 473/586 |
| 8,105,189 | B1 * | 1/2012 | Huang | F42B 6/06 473/586 |
| 8,128,522 | B1 * | 3/2012 | Rangel | F42B 6/06 473/586 |
| 8,323,133 | B1 * | 12/2012 | Middendorf | F42B 6/06 473/586 |
| 8,920,270 | B2 * | 12/2014 | DeLap | F42B 6/06 473/586 |
| 9,046,330 | B2 * | 6/2015 | Pedersen | F42B 6/06 |

* cited by examiner

VANE FOR AN ARROW, AND AN ARROW EXHIBITING VANES

This application is a national phase of International Application No. PCT/SE2015/000036 filed Jun. 15, 2015 and published in the English language, which claims priority to Swedish Patent Application No. SE 1400301-6 filed Jun. 13, 2014, which are hereby incorporated herein by reference in their entirety.

FIELD OF THE INVENTION

The present invention relates to fletching or vanes for arrows in archery and crossbow shooting, guiding the flight of the arrow through the air after the release, i.e. when the archer has released the arrow, and the arrow has left the string, and more particularly to a fletching or vane for quick stabilization of the flight of an arrow immediately after the release at instances of interference between the arrow and the bow, as well as an arrow fletched with such vanes.

BACKGROUND ART

Since archery has again been taken up on the Olympic programme (1972), competitive archery has developed strongly. This has increased the demand for performance and function of the equipment. The development has also influenced the design and rules valid for the target faces with a diameter of 48"/122 cm, which have been used since the first Olympic Games where archery was included (London 1908). The target faces were initially 5-ringed, scoring 9, 7, 5, 3, 1 with a diameter of 244 mm for the "gold" (score 9). The target faces used today are 10-ringed, scoring 10-1 with an "inner-ten" diameter of 61 mm. Of the scoring area for the highest score, i.e. the "gold", only 1/16th (6.25%) remains. Today's elite archers, however, remarkably often hit the "gold" from the maximum distance of 75 or 90 metres. The accuracy of aim is high. With the scoring area of the target faces reduced, at cases of interference with the bow, a minimal deviation in the flight of the arrow after release of the arrow is desirable.

The arrows, with a shaft of wood, which were used at the Olympic Games 1908 in London, were likely not to have had an initial velocity exceeding 30 metres per second. The arrows used today, however, often have an initial velocity exceeding 70 metres per second, sometimes even 100 metres per second.

At the bottom the vane usually has a longitudinal base, or "foot", for attachment to the arrow shaft, typically by means of gluing. The vanes are usually made from polymer materials of elastomeric type, e.g. elastomeric plastics, such as for example polyurethane, especially polyether urethane.

Typically three vanes are used for an arrow in archery, but other numbers of vanes are also used, e.g. two, especially for crossbow shooting, but also four, or five vanes are sometimes used for arrows in archery.

It is known that a deviation in the flight of an arrow may occur when the archer has released the arrow at cases of interference of the arrow with the bow after leaving the string.

U.S. Pat. No. 4,615,552 discloses vanes for stabilization of the flight of an arrow after the release. In one embodiment the vane exhibits a saw-teeth profile. In one embodiment the saw-teeth profile has valleys, the depth of which is up to ⅔ of the total height of the fletching vane above its base, and preferably about 40% the total height of the fletching vane above its base.

It has been found that it is possible, at cases of interference between an arrow and the bow, to markedly increase the accuracy of the shooting.

The present invention therefore constitutes an improvement of the vane according to the U.S. Pat. No. 4,615,552.

SUMMARY OF THE INVENTION

It has surprisingly been found that the flight of an arrow can be markedly further stabilized by means of a vane 10 exhibiting the characterizing features of claim 1, where the bottom 20 of the deepest valleys 40 is located at a height $H_{DB}$ of 17-30% of the total height $H_F$ of the vane, which vane thereby is endowed with an increased lateral flexing ability.

The inventive vane exhibits a saw-tooth like shape, having at the upper portion thereof rounded peaks 30.

Due to the saw-tooth like shape of the vane, having deep rounded valleys 40, an enhanced flexing ability is achieved in the outer vane portions 30 of the fletching. The increased flexing ability reduces the momentum transferred to the vane at instances of interference of the peripheral parts of the fletching, i.e. the outer vane portions 30 of the fletching, with the bow.

By virtue of the saw-tooth like shape of the vane, the area of the vane, which may interfere with the bow, is reduced.

In a preferred embodiment, a "hinge", i.e. a natural bending joint for the outer vane portions of the fletching in relation to the foot, is provided in the area just above the bottom 20 of the valleys.

According to the invention a hinge may be accomplished in different ways.

In one embodiment the frontal end of the outer vane portions exhibits a small notch 60, as illustrated in FIG. 1, and also in the partial view thereof, as shown in FIG. 2. A similar notch can, in a similar way, be arranged in the rear end of the outer vane portions.

In another embodiment the outer vane portions, in the area just above the foot, exhibit a perforation 70.

In yet another embodiment the vane, in an area just above the bottom of the valley, exhibits a locally reduced thickness of the material.

A combination of two, or three of the above options is also possible, whereby a further increased flexing ability is achieved.

The vane is preferably made from conventionally used polymeric materials in the art, such as polyurethane, especially polyether urethane, or copolymers having corresponding characteristics.

The increased lateral flexing ability of the outer vane portions reduces the deviation of flight of the arrow at cases of interference between the arrow and the bow in the form of contact of one or more vanes of the arrow with the arrow rest, or with the sight window of the handle section of the bow, when the arrow is passing the bow, i.e. after the archer has released the arrow, and the arrow has left the string.

Further advantages and features will become apparent from the following detailed description and appended claims.

Definitions

The term "foot" 50 has been used synonymously with "base" 50 herein, and refers to the lowest portion of the vane, which has a sufficient transversal width to provide a base for mounting the vane on the arrow shaft, such that the vane has its longitudinal extension in the axial direction of the arrow shaft, as shown in FIG. 4. The foot normally runs along the whole length of the vane. The foot typically has a width of 2-3 mm.

The term "inner vane portion" 80 refers to the inner portion of the vane, connecting the foot with the outer vane portions.

The terms "outer vane portion" 30, and "peak" 30, respectively, have been used synonymously herein.

The term "height of the bottom of the valley" $H_{DB}$ refers to the height of a bottom 20 of a valley above the underside 90 of the vane.

DETAILED DESCRIPTION

The vane according to the invention is designed to give the outer vane portions 30 extensive lateral flexing ability, reducing the deviation of flight of an arrow at cases of impingement of the arrow, or the fletching, on the arrow rest and/or on the sight window of the bow, i.e. interference between the arrow and bow, due to motorial shooting related errors of the archer. Such shooting related errors occur to archers "now and then" in connection with the release, due to nervousness during tournaments, stress, or for other reasons.

At interference with the bow, it is primarily the highest peaks of the respective vane that interfere. These are usually the peaks which are distributed over the rearmost 4 to 8 ninths of the length of the vane as counted from the front end of the vane, typically the rearmost 4-8 peaks as counted from the front end. The deepest valley(s) 40 is(are) found in this area. The height of the bottoms of the deepest valleys is 17 to 30%, preferably 17 to 25%, more preferably 20 to 25%, and especially about 25%, of the total height of the vane. The bottoms of the other valleys of the vane are suitably positioned approximately on the same height above the bottom of the underside of the vane as the former valleys. The very foremost, and rearmost peaks, respectively, are typically lower, about 2-4 mm, usually about 3 mm lower, in order to connect closer and more safely to the arrow shaft. These peaks—with their lower height—do not cause any interference when passing the bow, even at cases of impingement of the arrow on the bow.

The total height of the vane is usually 8-12.5 mm, especially 10-12 mm, e.g. about 11.5 mm.

The overall length of the vane is usually between 44-110 mm, e.g. about 45, about 57.5, about 70, about 89, or about 108 mm.

The inventive vane typically exhibits 4-10 peaks, evenly distributed over the length of the vane, preferably 4-9 peaks.

The distance between two neighbouring peaks is suitably about 10-12.5 mm, centre to centre.

Figure 1:
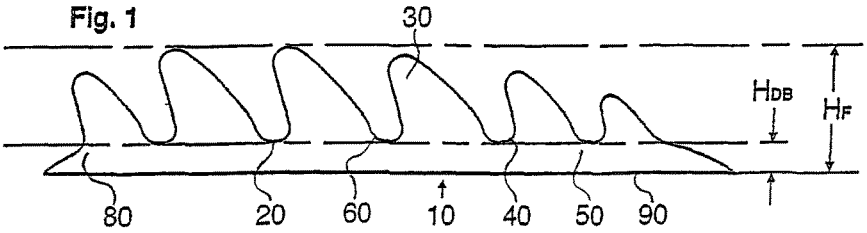
FIG. 1 illustrates an embodiment of a vane 10 according to the invention.
Figure 2:
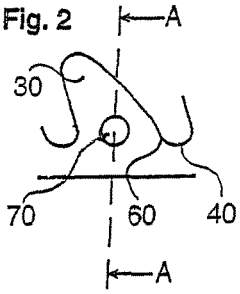
FIG. 2 is a partial view of an embodiment of the vane wherein the outer vane portions 30 are provided with perforations 70 just above the base.
Figure 3:
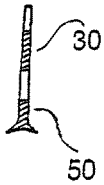
FIG. 3 shows a view along the section A-A in FIG. 2.

In the front end the peaks exhibit a sharper angle against the longitudinal axis, and in the rear end a more blunt angle, as illustrated in FIGS. 1-3.

The arrow, which after the release will pass the handle section of the bow, will until the moment of shooting remain with its foremost portion resting on the arrow rest. If the arrow is released without any shooting related mistake, the arrow and the fletching will, during buckling of the arrow (i.e. bending of the arrow shaft), pass outside or next to the bow without interference, and then without any resulting deviation of flight. The bending of the arrow and its passage of the bow, is sometimes in the literature described as the "Archer's Paradox". Physically, it is an effect of the energy stored in the bent limbs of the bow, which, after the archer's release, will be transferred as kinetic energy to the arrow; a part of this energy will give rise to the bending of the arrow shaft; the remaining part of the energy will accelerate the arrow, which will then in a bent state, pass outside/next to the bow and the arrow rest, which may be perceived as a "paradox".

The technical development of equipment used in the archery sport today, has broadly followed the developments in materials engineering during the years from 1900 until about 2014. For arrow shafts, thin-wall tubes of high alloy/after-hardened steel qualities have been used during a period of time. Later on, the choice of material has been shifted to modern aluminium alloys, featuring high modulus of elasticity (from the aircraft industry). The development over the last approximately 30 years of polymeric materials in combination with composites, e.g. carbon fibre, has provided the market with arrow shafts of low weight with very high stiffness. The combination of these properties makes the bending of the arrow shaft quicker, and reduces the extent of bending (with reduced amplitudes of oscillation), which increases the demands of "tuning" of the arrow and its fletching. This "tuning" and trimming is important in order to reduce the risk for impingement of the arrow on the bow, i.e. interference of the arrow and bow, during the arrow's passage of the bow, when the archer has released the arrow.

While the outer vane portions 30 have been endowed with increased lateral bending ability, the vanes must however have sufficient stability in order to avoid so-called "flutter" after the release, when the arrow has left the string, and the flight of the arrow through the air shall be stabilized. According to the invention, this is achieved by means of the bottoms 20 of the deepest valleys having a height of 17-30% of the total height of the vane. Accordingly, the inner vane portion 80, which connects the outer vane portions 30, has a height of at least 30% of the height off the tallest peaks, as measured from the underside 90 of the vane. It has been found that the vane thereby will be stabilized, so that flutter does not arise, at the same time as an increased flexing ability of the peaks is secured.

The thickness of the vane is usually between 0.4 and 1 mm, e.g. about 0.5-0.7 mm.

In embodiments with a locally reduced thickness just above the bottom of a valley(s), the thickness must not be reduced by more than about 5% in order for flutter not to arise. It has been found that an increased flexing ability is achieved already when the thickness is reduced by about 2%. A preferred reduced thickness, is a thickness reduced by 2-4%.

The area with a reduced thickness may suitably extend up to 4 mm above the bottom 20 of the valley(s) and may extend vertically about 3-4 mm.

It is also conceivable, although less preferred, in an alternative embodiment, that the upper portions of the peaks may exhibit an increased material thickness. In such case, the increased material thickness would be in the area of the uppermost about 4-6 mm of the peaks. In order for flutter to be avoided the increase may not exceed 5%.

At a private property, to which no member of the public have had access, extensive comparative test shooting of arrows provided with the new fletching of the invention in its most generic embodiment, and of arrows with fletching consisting of vanes of various designs of conventional type, including vanes of U.S. Pat. No. 4,615,552, respectively, has been carried out. The "forgiving" properties of the fletching according to the invention have then been established in terms of a reduced deviation of flight at cases of interference between the arrow and the bow.

A reasonable assumption in this context could be that, at a final competition for gold, "archer-against-archer", the choice of fletching might very well be critical to the outcome.

Figure 4:
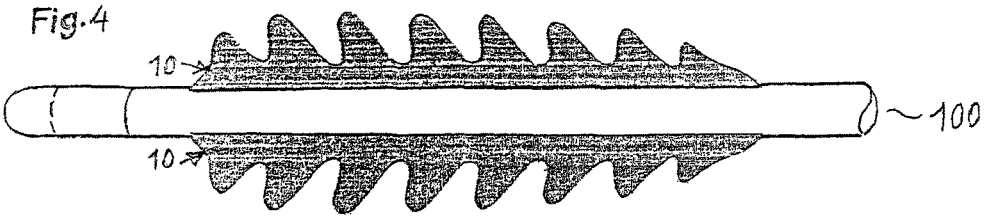
FIG. 4 illustrates an embodiment of an arrow 100 of the invention, exhibiting two vanes 10 of the invention.

The inventive vanes can be mounted on an arrow in a conventional manner, suitably by gluing against the arrow shaft. An arrow typically exhibits 2-5 vanes, crossbow arrows, however, typically exhibit 2 vanes (as shown in FIG. 4) or 3 vanes, while arrows for archery typically exhibit 3-5 vanes, especially 3 vanes.

In embodiments exhibiting perforation(s), e.g. in the form of a through hole with a diameter of about 2-4 mm, preferably about 2.5 mm, positioned centrally in the lower portion of the respective outer vane portion, the perforation 70 is suitably located with its lower edge level with the bottom 20 of the valley(s).

The invention claimed is:

1. A vane for guiding and stabilizing flight of an arrow through air after being released from a bow or crossbow provided with a string, the string of which bow or crossbow, at the time of release, is in engagement with a rear end of the arrow, said vane having an elongated and substantially planar body comprising:

a foot having a sufficient transversal width to provide a base for mounting of the vane on an arrow shaft, such that said elongated body has a longitudinal extension in an axial direction of the arrow shaft;

a plurality of outer vane portions extending radially in a plane of said elongated body; and an inner vane portion connecting the foot and said outer vane portions, wherein, between two neighboring outer vane portions, a respective valley, having a rounded shape at the bottom thereof, is formed by said two neighboring outer vane portions and the inner vane portion, with plural said valleys being formed between respective neighboring outer vane portions;

wherein a bottom of a deepest one of said valleys is located at a height of 17-30% of a total height of the vane;

wherein there are at least three outer vane portions defining respective peaks that progressively increase in height and then progressively decrease in height going from front to rear; and wherein a natural bending joint for the outer vane portions in relation to the foot is provided in an area just above the bottom of the valleys.

2. The vane of claim 1, wherein the outer vane portions, in at least one of a lower portion of a frontal end thereof and a lower portion of a rear end thereof, exhibit a small notch.

3. The vane of claim 1, wherein one or more of the outer vane portions, in an area just above the base, exhibit a perforation.

4. The vane of claim 1, wherein the vane is formed from polyurethane.

5. The vane of claim 1, wherein the outer vane portions are arranged to form 4-10 peaks, evenly distributed over a length of the vane.

6. An arrow including the shaft and a plurality of vanes according to claim 1 mounted to the shaft.

7. A vane for guiding and stabilizing flight of an arrow through air after being released from a bow or crossbow provided with a string, the string of which bow or crossbow, at the time of release, is in engagement with a rear end of the arrow, said vane having an elongated and substantially planar body comprising:

a foot having a sufficient transversal width to provide a base for mounting of the vane on an arrow shaft, such that said elongated body has a longitudinal extension in an axial direction of the arrow shaft;

a plurality of outer vane portions extending radially in a plane of said elongated body; and an inner vane portion connecting the foot and said outer vane portions, wherein, between two neighboring outer vane portions, a respective valley, having a rounded shape at the bottom thereof, is formed by said two neighboring outer vane portions and the inner vane portion, with plural said valleys being formed between respective neighboring outer vane portions;

wherein a bottom of a deepest one of said valleys is located at a height of 17-30% of a total height of the vane;

wherein there are at least three outer vane portions defining respective peaks that progressively increase in height and then progressively decrease in height going from front to rear; and wherein the vane, in an area just above the bottom of the valleys, exhibits a locally reduced thickness.

* * * * *